US010253730B2

(12) United States Patent
Yoon et al.

(10) Patent No.: US 10,253,730 B2
(45) Date of Patent: Apr. 9, 2019

(54) WATER-COOLED EGR COOLER, AND THE MANUFACTURING METHOD THEREOF

(71) Applicants: Hyundai Motor Company, Seoul (KR); Kia Motors Corporation, Seoul (KR)

(72) Inventors: Sung Il Yoon, Seoul (KR); Dong Young Lee, Goyang-si (KR); Do Jun Park, Ulsan (KR); Seogjin Yoon, Suwon-si (KR); In Sung Yun, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/802,150

(22) Filed: Nov. 2, 2017

(65) Prior Publication Data

US 2018/0328317 A1 Nov. 15, 2018

(30) Foreign Application Priority Data

May 11, 2017 (KR) ..... 10-2017-0058625

(51) Int. Cl.
*F02M 26/00* (2016.01)
*F02M 26/32* (2016.01)

(52) U.S. Cl.
CPC ..... *F02M 26/32* (2016.02); *F02M 2200/9076* (2013.01)

(58) Field of Classification Search
CPC ..... F02M 26/32
See application file for complete search history.

(56) References Cited

U.S. PATENT DOCUMENTS

| | | | | |
|---|---|---|---|---|
| 2,757,628 | A * | 8/1956 | Johnston | B21D 53/04 29/890.047 |
| 5,491,997 | A * | 2/1996 | Ogawa | B21D 13/045 72/177 |
| 6,371,201 | B1 * | 4/2002 | Evans | B23K 35/286 165/177 |
| 7,614,443 | B2 * | 11/2009 | Usui | F28D 7/1684 165/177 |
| 9,303,925 | B2 * | 4/2016 | Zhang | F28F 9/02 |
| 2001/0047861 | A1 * | 12/2001 | Maeda | B23K 1/0012 165/167 |
| 2004/0069475 | A1 * | 4/2004 | Brost | F28D 9/0043 165/173 |
| 2004/0099408 | A1 * | 5/2004 | Shabtay | F28F 1/003 165/177 |

(Continued)

FOREIGN PATENT DOCUMENTS

| | | | |
|---|---|---|---|
| JP | 2016-044548 | A | 4/2016 |
| KR | 10-2014-0000406 | A | 1/2014 |

*Primary Examiner* — Hieu T Vo
*Assistant Examiner* — Sherman Manley
(74) *Attorney, Agent, or Firm* — Morgan, Lewis & Bockius LLP

(57) ABSTRACT

A water-cooled EGR cooler apparatus may include tubes in which gas passage is formed, and a tube bonded portion that internally and externally seals is provided, pins disposed at the gas passage of the tubes, and of which one surface contact and are bonded with the tube bonded portion, and supporters disposed between the tubes to form coolant passages and of which one surface contact and are bonded with the tube bonded portion.

16 Claims, 4 Drawing Sheets

(56) References Cited

U.S. PATENT DOCUMENTS

2005/0006066 A1* 1/2005 Emrich ..... F02B 29/045 165/133
2006/0016582 A1* 1/2006 Hashimoto ..... F28D 7/1684 165/109.1
2006/0283585 A1* 12/2006 Smith ..... F28F 3/025 165/177
2007/0051503 A1* 3/2007 Grajzl ..... F02B 29/0456 165/152
2007/0119576 A1* 5/2007 Agee ..... F28D 7/0041 165/109.1
2007/0137841 A1* 6/2007 Bjork ..... F28F 1/126 165/153
2007/0235164 A1* 10/2007 Miyagawa ..... F01N 5/02 165/104.14
2008/0011464 A1* 1/2008 Oofune ..... F28D 7/1684 165/157
2008/0078533 A1* 4/2008 Tolani ..... F02B 29/0462 165/133
2008/0190403 A1* 8/2008 Grunenwald ..... C23F 13/14 123/568.12
2008/0202724 A1* 8/2008 Lorenz ..... F28D 7/0075 165/51
2008/0277105 A1* 11/2008 Geskes ..... F02B 29/0462 165/162
2008/0314569 A1* 12/2008 Yamazaki ..... F02M 37/0029 165/153
2009/0020275 A1* 1/2009 Neher ..... F28D 7/1684 165/170
2009/0025915 A1* 1/2009 Qvist ..... F28D 7/1653 165/149
2009/0025916 A1* 1/2009 Meshenky ..... B21D 13/08 165/151
2009/0282850 A1* 11/2009 Higashiyama ..... F25B 39/02 62/239
2010/0044019 A1* 2/2010 Maeda ..... F28D 7/0041 165/151
2011/0056652 A1* 3/2011 Neher ..... F28D 7/1684 165/81
2011/0100615 A1* 5/2011 Henry ..... B23K 35/0238 165/177
2011/0114299 A1* 5/2011 Aplienz ..... B21D 5/12 165/175
2013/0098341 A1* 4/2013 Yoon ..... F02B 29/0456 123/568.12
2014/0060504 A1* 3/2014 Collins ..... F02M 26/32 123/568.12
2014/0182821 A1* 7/2014 Perrin ..... B32B 15/016 165/109.1
2015/0107807 A1* 4/2015 Hund ..... F28D 1/0475 165/158
2016/0208746 A1* 7/2016 Geskes ..... F28F 1/422

* cited by examiner

WATER-COOLED EGR COOLER, AND THE MANUFACTURING METHOD THEREOF

CROSS-REFERENCE TO RELATED APPLICATION

The present application claims priority to Korean Patent Application No. 10-2017-0058625 filed on May 11, 2017, the entire contents of which is incorporated herein for all purposes by this reference.

BACKGROUND OF THE INVENTION

Field of the Invention

The present invention relates to a water-cooled EGR cooler configured for cooling exhaust gas re-circulated with a coolant. More particularly, the present invention relates to a water-cooled EGR cooler for increasing corrosion-resisting characteristics by improving bonding structure.

Description of Related Art

In recent years, as environmental problems such as global warming emerge, regulations for exhaust gas have been tightened, in particular, emissions of exhaust gas of a vehicle have been strictly controlled.

Particularly, under the EURO-6, in a case of a diesel engine for a car, the quantity of NOx generated needs to be decreased to a level of 80 mg/km, and in this respect, the automobile related companies have adopted new technologies, such as exhaust gas recirculation (EGR) device, a lean NOx trap (LNT), and a selective catalytic reduction (SCR).

The exhaust gas recirculation (EGR) device includes a high pressure exhaust gas recirculation (HP-EGR) device, which recirculates exhaust gas at a front end portion of a catalyst, and a low pressure exhaust gas recirculation (LP-EGR) device, which recirculates exhaust gas at a rear end portion of the catalyst.

In the instant case, to cool the recirculated exhaust gas, an EGR cooler is disposed in an exhaust gas recirculation line, and the EGR cooler includes a stainless material having high corrosion resistivity to high temperature state and condensate water.

However, the EGR cooler including the stainless material is heavy, has low heat transfer efficiency, and has a poor molding property, and the entire components are expensive. Accordingly, research on the EGR cooler, which has high heat transfer efficiency, has an excellent molding property, and includes aluminum, and of which components are relatively cheap, has been conducted.

Typically, this aluminum material EGR cooler includes a pin and tubes, A1100 which is based on pure aluminum (A1xxx) and A3003 which is based on aluminum-manganese (A3xxx) may be used in the pin and tubes.

Meanwhile, a temperature of recirculated exhaust gas is about 550° C. and corrosive ions, such as Cl—, SO42-, and NO3-, exist as a component of condensate water, so that the aluminum-based pin or tube may be damaged in a high temperature environment and a corrosive environment. In the present respect, research on an aluminum sheet having high strength and high corrosion resistivity is conducted.

Welding portion of the tube corrupts in condensate water and high temperature condition, and coolant leaks toward internal to the tube, therefore, durability of the EGR cooler may be deteriorated. Therefore, research on an a bonding structure of the tube and the pin and a bonding structure of a supporter disposed between the tubes. Aluminum sheet having high strength and high corrosion resistivity is conducted The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a water-cooled EGR cooler and manufacturing method thereof, in which combination structure of tubes, pins and supporters to improve corrosion resistivity in high temperature and condensed water and improve durability and operation reliability of an engine.

A water-cooled exhaust gas recirculation (EGR) cooler according to an exemplary embodiment of the present invention includes tubes in which gas passage is formed, and a tube bonded portion that internally and externally seals is provided, pins disposed at the gas passage of the tubes, and of which one surface contact and are bonded with the tube bonded portion, and supporters disposed between the tubes to form coolant passages and of which one surface contact and are bonded with the tube bonded portion.

The tubes, the pins and the supporters may include aluminum.

The tubes may be formed by bending one sheet, form confront portion by putting cut surfaces of both side edge portions of the sheet opposite to each other, and form the tube bonded portion by bonding the confront portion.

The pins may be formed by bending one sheet in a zig-zag shape, and of which outside surface contact and be bonded with inside surface of the tubes.

The supporters may be formed by bending one sheet in a zig-zag shape, and of which outside surface contact and be bonded with outside surface of the tubes.

The pins and the supporters may contact and be bonded with inside and outside surfaces of the tubes respectively according to the tube bonded portion to seal the tube bonded portion.

The tube bonded portion may be formed by irradiating laser along the confront portion, and simultaneously the tubes and the pins may be bonded with each other.

The supporters and the tubes may be bonded with each other by brazing welding.

A manufacturing method of a water-cooled exhaust gas recirculation (EGR) cooler according to an exemplary embodiment of the present invention includes forming tubes by bending a sheet to have confront portion by putting cut surfaces of both side edge portions of the sheet opposite to each other, inserting pins into inside of the tubes and contacting one surface of the pins with the confront portion, forming the tube bonded portion by irradiating laser along the confront portion, and simultaneously bonding the tubes and the pins with each other, and disposing the supporters between the tubes and bonding the tubes and the supporters with each other.

According to the exemplary embodiment of the present invention, the tubes and the pins are bonded in multiple with each other to prevent the tube bonded portion from being corroded. Furthermore, it may be prevented that the coolant is mixed with the EGR gas by corrosion and being supplied to the engine.

Accordingly, durability of the EGR cooler including aluminum material may be improved, and operation reliability of the engine may be improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
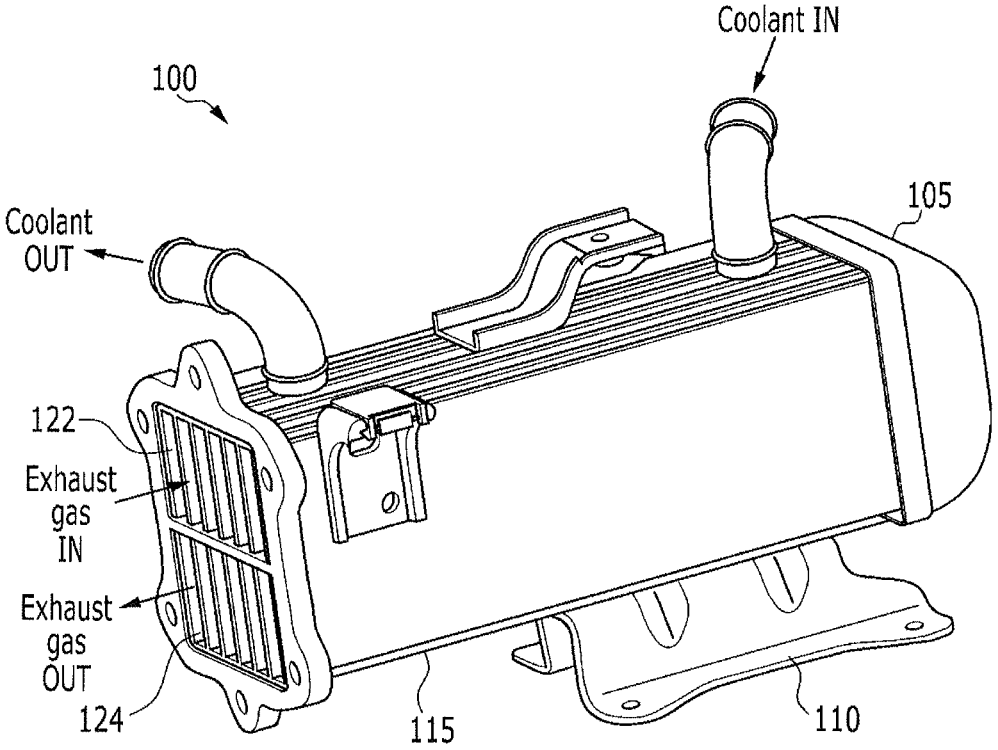
FIG. 1 is a perspective view of a water-cooled EGR cooler according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described more specifically with reference to the accompanying drawings.

Furthermore, the size and thickness of each configuration shown in the drawings are arbitrarily shown for understanding and ease of description, but the present invention is not limited thereto, and the thickness of layers, films, panels, regions, etc., are exaggerated for clarity.

Also, the drawings and description are to be regarded as illustrative in nature and not restrictive. Like reference numerals designate like elements throughout the specification.

Discriminating the names of components with the first, the second, etc. in the following description is for discriminating them for the same relationship of the components and the components are not limited to the order in the following description. Also, exhaust gas recirculation device may be appended as EGR device or EGR.

FIG. 1 is a perspective view of a water-cooled EGR cooler according to an exemplary embodiment of the present invention.

Referring to FIG. 1, an EGR cooler 100 includes a housing 115, a mounting flange 110, and a 'U'-shaped flange 105 as major components.

A coolant inlet pipe, into which a coolant flows, is connected to one end portion at an upper side of the housing 115, and a coolant discharge pipe, through which the coolant is discharged, is connected to the other end portion at the upper side of the housing 115.

A coolant inlet pipe, into which a coolant flows, is connected to one end portion at an upper side of the housing 115, and a coolant discharge pipe, through which the coolant is discharged, is connected to the other end portion at the upper side of the housing 115.

The 'U'-shaped flange 105 is mounted on the other end surface of the housing 115, and the 'U'-shaped flange 105 communicates the upper portion and the lower portion of the housing 115.

The exhaust gas supplied through the exhaust gas inlet 122 of the housing 115 flows to the upper side of the housing 115, passes through the 'U'-shaped flange 105, and flows to the lower side of the housing 115, and is joined to an intake line through the exhaust gas outlet 124. Furthermore, the mounting flange 110 fixes the housing 115 to one side of an engine.

In an exemplary embodiment of the present invention, the drawings are illustrated for enhancing of understanding of the contents, and when there is no special comment, an upper, a lower, left and right directions may be different from the actual directions.

Figure 2:
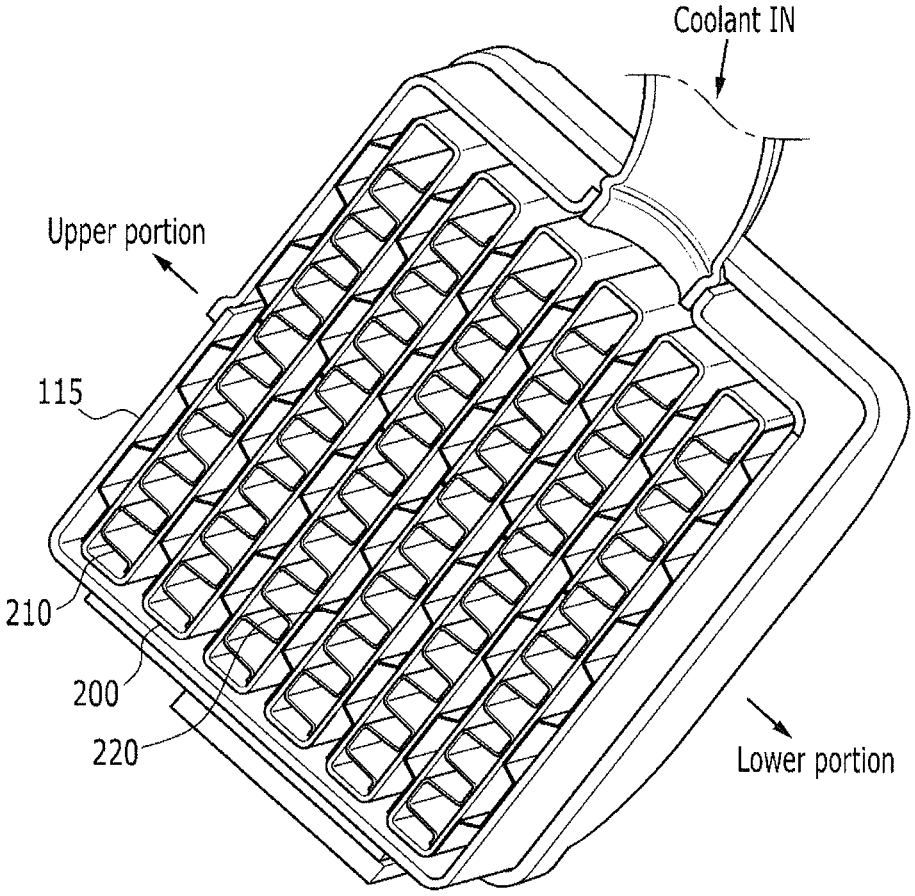
FIG. 2 is a perspective view of a cross-section of the water-cooled EGR cooler according to an exemplary embodiment of the present invention.

FIG. 2 is a perspective view of a cross-section of the water-cooled EGR cooler according to an exemplary embodiment of the present invention.

Referring to FIG. 2, in the EGR cooler 100, tubes 200, pins 210, and supporters 220 are disposed inside the housing 115.

The tubes 200 have a flat shape and extend in a longitudinal direction, and in which exhaust gas passes. Furthermore, the tubes 200 are disposed at a predetermined interval.

The supporters 220 are located between the tubes 200. The supporters 220 maintain a predetermined interval between the tubes 200, and form a path, in which the coolant flows, between the tubes 200.

Furthermore, the pin 210 is disposed inside the tube 200, and the pin 210 is bent in a zig-zag shape, and an external surface of the pin 210 is brazed and in contact with an internal surface of the tube 200.

The tube 200 has a structure that a coolant flows into an external side of the tube 200, and the pin 210 disposed at the internal side of the tube 200 improves efficiency of heat exchange between the coolant and the EGR gas.

Figure 3:
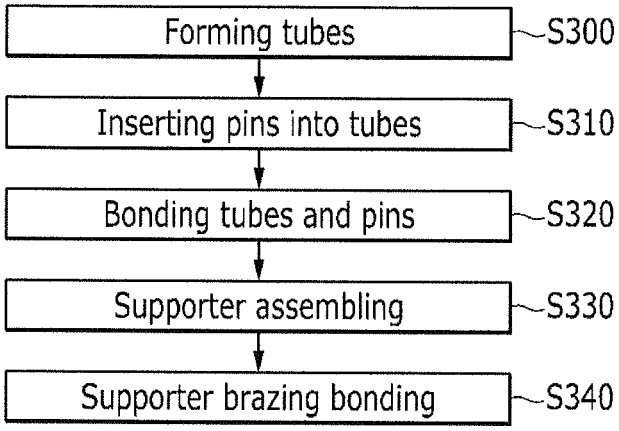
FIG. 3 is a flow-chart illustrating manufacturing method of a water-cooled EGR cooler according to an exemplary embodiment of the present invention.
Figure 4:
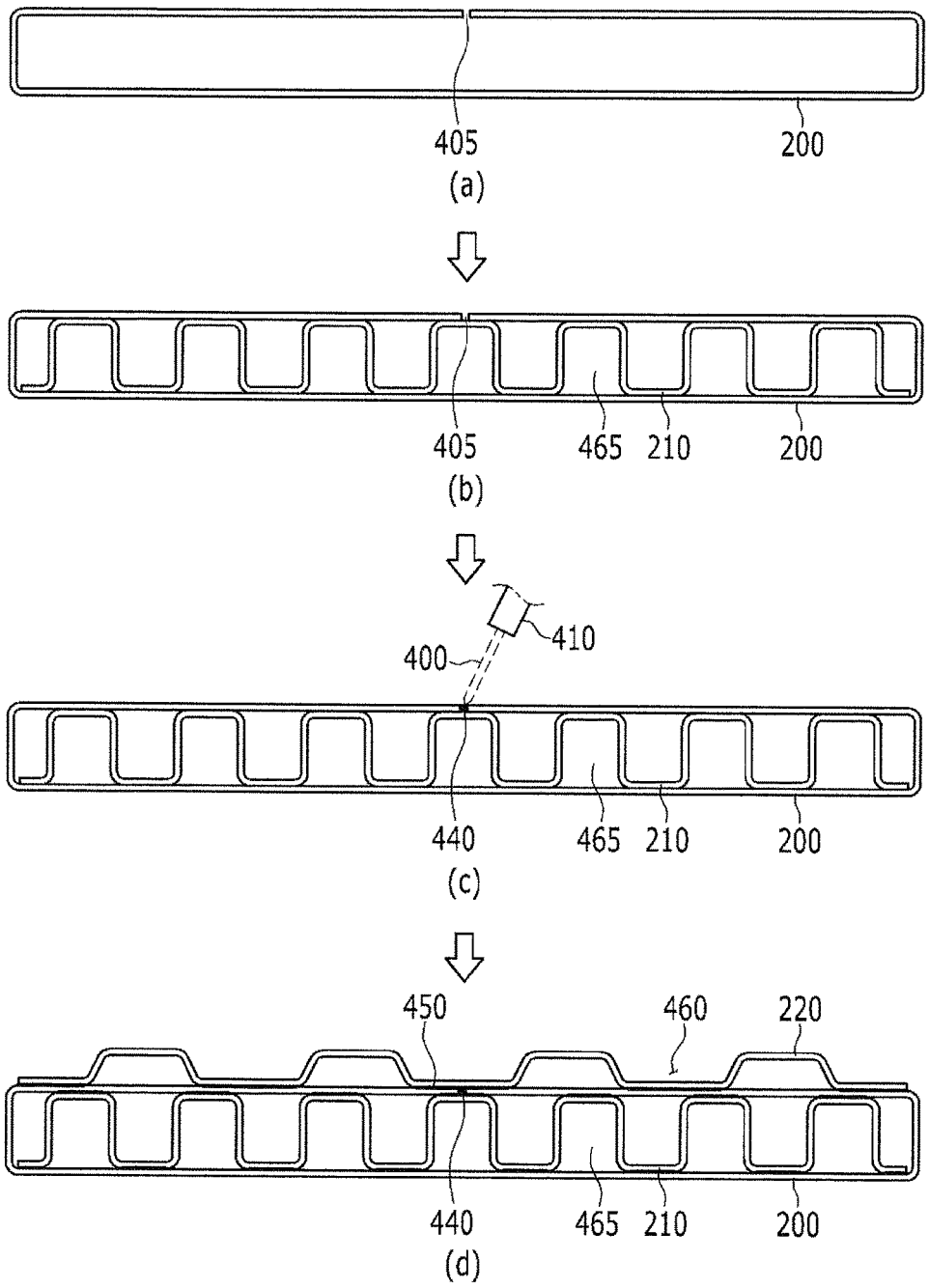
FIG. 4 is a cross-sectional view illustrating manufacturing order of a water-cooled EGR cooler according to an exemplary embodiment of the present invention.

Regarding manufacturing order and method of a water-cooled exhaust gas recirculation (EGR) cooler according to an exemplary embodiment of the present invention are described referring to FIG. 4 and FIG. 3.

FIG. 4 is a cross-sectional view illustrating manufacturing order of a water-cooled EGR cooler according to an exemplary embodiment of the present invention.

Referring to (a) of FIG. 4, the tubes 200 are formed as thin and long pipe shape by bending one sheet, and confront portion 405 are formed by putting cut surfaces of both side edge portions of the sheet opposite to each other. Here, the confront portion 405 is formed at an upper side of the tubes 200.

Referring to (b) of FIG. 4, the gas passage 465 is formed internal to the tubes 200, and the pins 210 are inserted internal to the gas passage 465.

The pins 210 are formed by bending one sheet in a zig-zag shape, and of which upper and lower surfaces contact with internal to upper and lower surfaces of the tubes 200. Here, the portions that the pins 210 and the tubes 200 contact with each other cover the confront portion 405.

Referring to (c) of FIG. 4, the confront portion 405 is bonded by irradiating laser 400 along the confront portion 405 by use of the laser irradiator 410, and simultaneously the tubes 200 and the pins 210 are bonded with each other, therefore the tube bonded portion 440 is formed.

Referring to (d) of FIG. 4, the water-cooled EGR cooler includes tubes 200, pins 210, supporters 220, a gas passage 465, a supporter bonded portion 450, and a tube bonded portion 300.

The supporters 220 are disposed between the tubes 200, and one side of outside surface of the supporters 220 covers the tube bonded portion 440. Here, the supporters 220 and the tubes 200 are bonded with each other by brazing welding to form the supporter bonded portion 450 by heating the supporters 220 and the tubes 200 up to brazing temperature.

FIG. 3 is a flow-chart illustrating manufacturing method of a water-cooled EGR cooler according to an exemplary embodiment of the present invention.

Referring to FIG. 3, S300 is a step of forming tubes 200. One sheet is bent to be formed at the tubes 200 having a thin and wide pipe shape. Here, the confront portion 405 of which opposite cut surface formed at both end portions of the sheet is formed at the tubes 200, and the sheet may include aluminum.

S310 is a step of inserting pins 210. One sheet is bent in a zig-zag shape, and the bent pins 210 are inserted into inside of the tubes 200.

S320 is a step of welding the tubes 200 and the pins 210. The confront portion 405 of the tubes 200 is welded by use of a laser, and simultaneously the tubes 200 and the pins 210 are bonded with each other.

S330 is a step of supporter assembling, in a state that the tubes 200 and the pins 210 are bonded with each other by laser, the supporters 220 are located between the tubes 200.

S340 is a step of brazing bonding, the tubes 200 and the supporters 220 that the pins 210 are bonded with are heated to brazing temperature, so that the tubes 200 and the supporters 220 are bonded with each other by brazing welding.

Furthermore, in an exemplary embodiment of the present invention, referring to FIG. 4(*a*) again, the confront portion 405 is formed on the tubes 200, and like FIG. 4(*c*), the laser is irradiated to the tubes 200 to form the tube bonded portion 440, and the tube bonded portion 440 is formed on the upper side of the tubes 200.

Accordingly, the condensate water in the tubes 200 flows along the lower portion of inside the tubes 200, therefore the tube bonded portion 440 formed on the upper portion of inside the tubes 200 may not be corroded. Furthermore, the bonded portion is formed in duplication by the tube bonded portion 440 and the supporter bonded portion 450, therefore the corrosion resistivity may be more improved.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A water-cooled exhaust gas recirculation (EGR) cooler apparatus, comprising:

tubes in which gas passage is formed, and a tube bonded portion that internally and externally seals is provided in the tubes;

pins disposed at the gas passage of the tubes, wherein a surface of the pins contacts with and is bonded with the tube bonded portion; and supporters disposed between the tubes to form coolant passages wherein a surface of the supporters contacts with and is bonded with the tube bonded portion.

2. The water-cooled EGR cooler apparatus of claim 1, wherein the tubes, the pins and the supporters include aluminum.

3. The water-cooled EGR cooler apparatus of claim 1, wherein the tubes are formed by bending one sheet, forms a confront portion by putting cut surfaces of first and second side edge portions of the sheet opposite to each other, and forms the tube bonded portion by bonding the confront portion.

4. The water-cooled EGR cooler apparatus of claim 1, wherein the pins are formed by bending a sheet in a zig-zag shape, and of which outside surface contacts and is bonded with inside surface of the tubes.

5. The water-cooled EGR cooler apparatus of claim 1, wherein the supporters are formed by bending a sheet in a zig-zag shape, wherein an outside surface of the supporters contacts with and is bonded with an outside surface of the tubes.

6. The water-cooled EGR cooler apparatus of claim 1, wherein the pins and the supporters contact with and are bonded with inside and outside surfaces of the tubes respectively to seal the tube bonded portion.

7. The water-cooled EGR cooler apparatus of claim 3, wherein the tube bonded portion is formed by irradiating laser along the confront portion, and the tubes and the pins are bonded with each other.

8. The water-cooled EGR cooler apparatus of claim 1, wherein the supporters and the tubes are bonded with each other by brazing welding.

9. A manufacturing method of a water-cooled exhaust gas recirculation (EGR) cooler apparatus, comprising:

forming tubes by bending a sheet to have a confront portion by putting cut surfaces of first and second side edge portions of the sheet opposite to each other;

inserting pins into inside of the tubes and contacting a surface of the pins with the confront portion;

forming a tube bonded portion by irradiating laser along the confront portion, and bonding the tubes and the pins with each other; and disposing supporters between the tubes and bonding the tubes and the supporters with each other.

10. The manufacturing method of the water-cooled EGR cooler apparatus of claim 9, wherein the tubes, the pins and the supporters include aluminum.

11. The manufacturing method of the water-cooled EGR cooler apparatus of claim 9, wherein the pins are formed by bending a sheet in a zig-zag shape, wherein one side surface of the pins contacts with an internal surface of the tubes along the confront portion.

12. The manufacturing method of the water-cooled EGR cooler apparatus of claim 9, wherein the supporter are formed by bending a sheet in a zig-zag shape, wherein outside surface of the supporters contacts with and is bonded with an outside surface of the tubes.

13. The manufacturing method of the water-cooled EGR cooler apparatus of claim 9, wherein the pins and the supporters contact and are bonded with outside surfaces of the tube bonded portion to seal the tube bonded portion.

14. The manufacturing method of the water-cooled EGR cooler apparatus of claim 9, wherein the supporters and the tubes are bonded with each other by brazing welding.

15. An engine having a water-cooled EGR cooler according to claim 1.

16. An engine made by the manufacturing method of a water-cooled EGR cooler according to claim 9.

* * * * *